US006637863B2

(12) United States Patent
Jones

(10) Patent No.: US 6,637,863 B2
(45) Date of Patent: Oct. 28, 2003

(54) PRINT CARTRIDGE LATCHING SYSTEM

(75) Inventor: Gene D Jones, Yacolt, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/829,501

(22) Filed: Apr. 9, 2001

(65) Prior Publication Data

US 2002/0146267 A1 Oct. 10, 2002

(51) Int. Cl.[7] ..... B41J 2/175
(52) U.S. Cl. ..... 347/49; 347/37; 400/663
(58) Field of Search ..... 347/49, 86, 37, 347/39, 87; 400/663

(56) References Cited

U.S. PATENT DOCUMENTS 6,312,105 B1 * 11/2001 Miyauchi ..... 347/49
2001/0026300 A1 * 10/2001 Yamaguchi et al. ..... 347/49
2002/0030718 A1 * 3/2002 Kline et al. ..... 347/49
2002/0135634 A1 * 9/2002 Lodal et al. ..... 347/37

FOREIGN PATENT DOCUMENTS

EP 0729844 9/1996
JP 04014454 A * 1/1992 ..... B41J/2/01
JP 09123479 A1 * 5/1997 ..... B41J/2/175

* cited by examiner

*Primary Examiner*—Daniel J. Colilla

(57) ABSTRACT

An ink jet printer including a print carriage and a latching assembly for latching print cartridges in the print carriage. The print cartridge includes a latch feature on a top wall of the cartridge body, and the latching assembly includes a latch arm hingeably attached to a cartridge receiving chute of the print carriage, a clamp structure supported by the latch arm for applying a first clamp force and a second clamp force to the cartridge latch feature generally along respective orthogonal axes and independently of each other.

21 Claims, 6 Drawing Sheets

FIG. 7
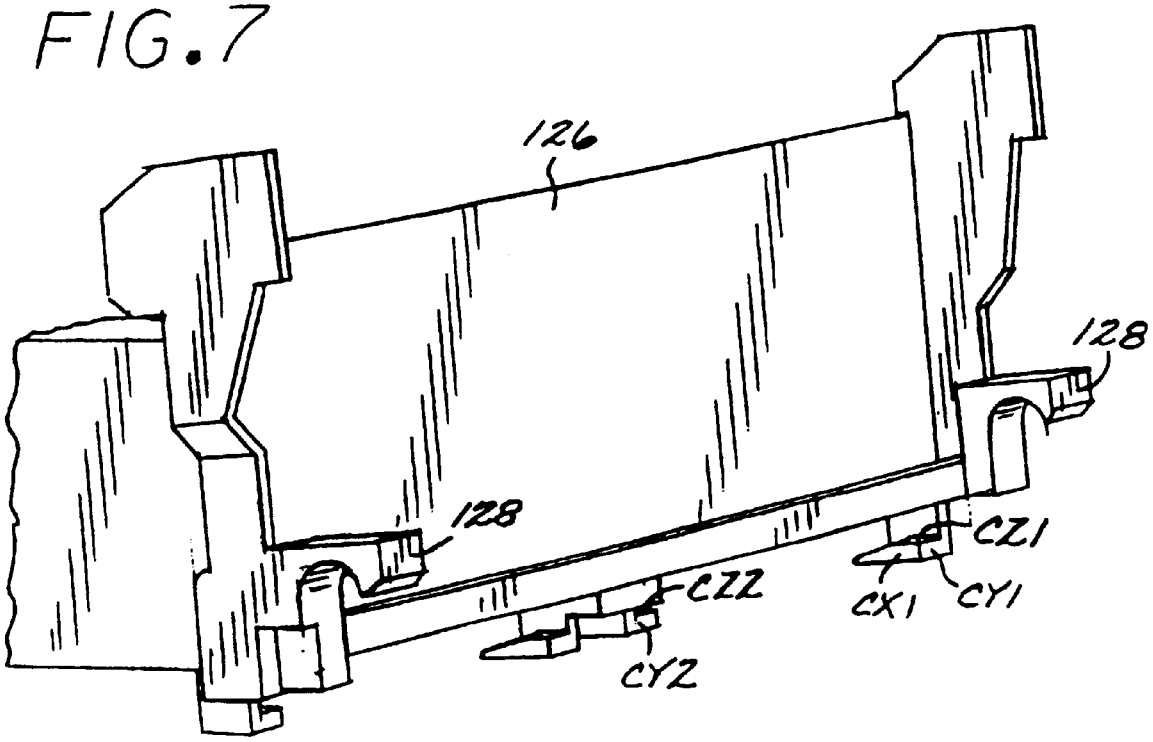
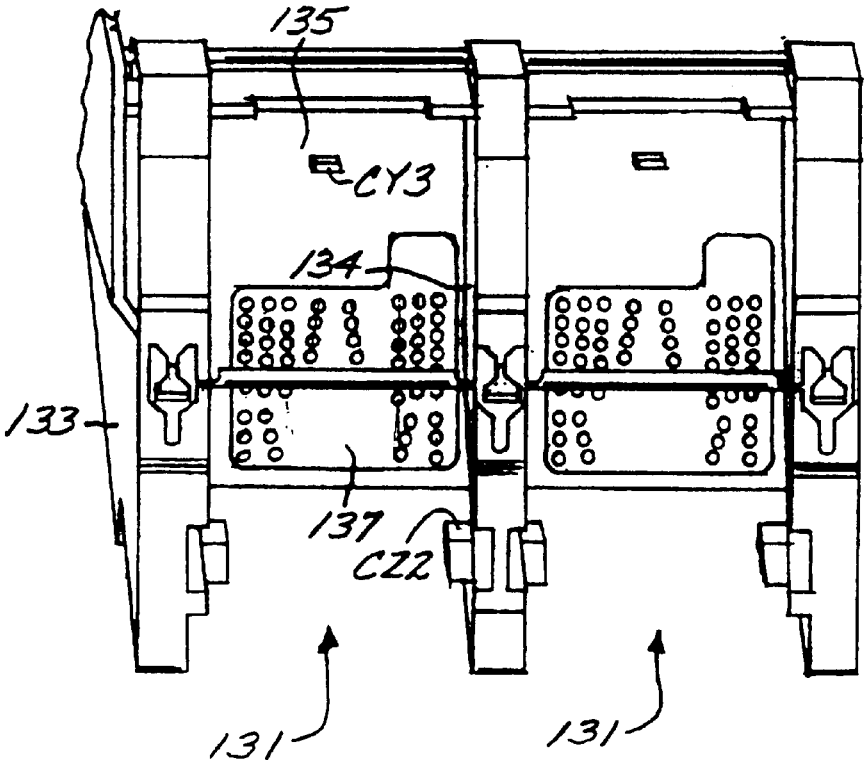
FIG. 6

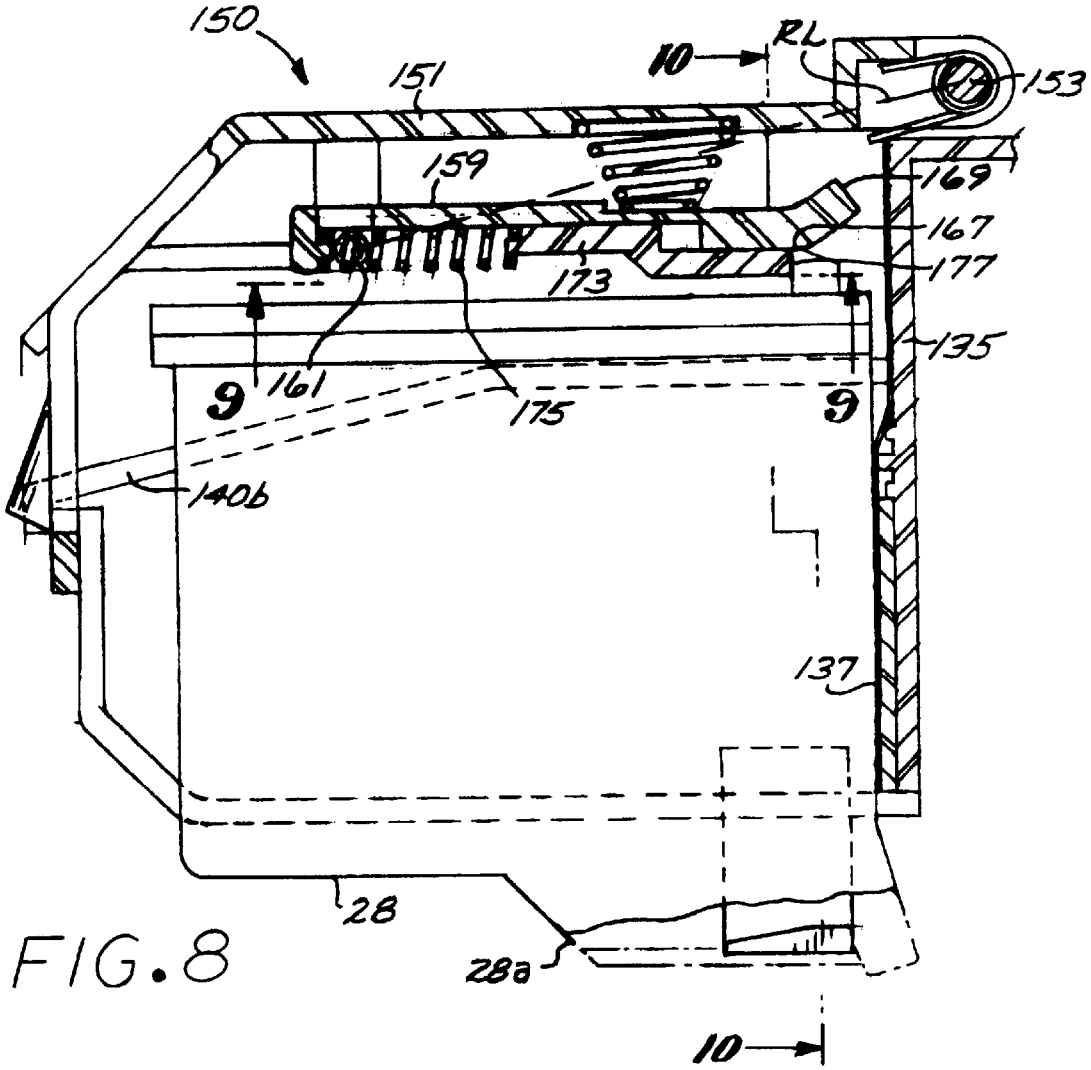
FIG. 8
FIG. 9
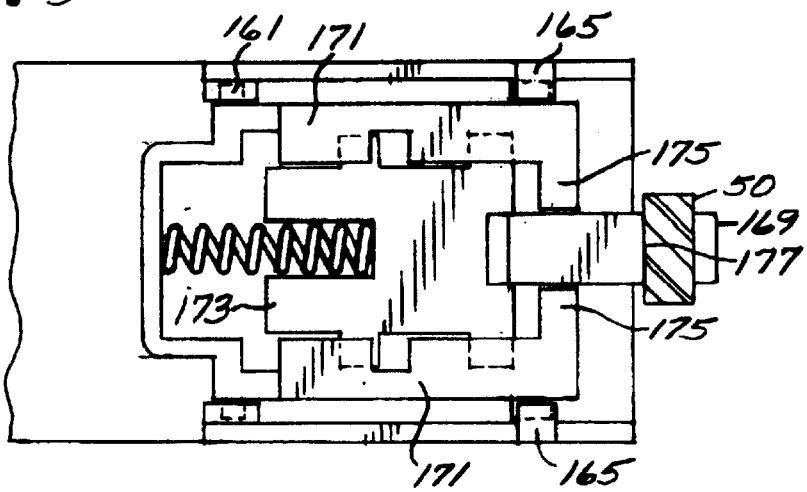

PRINT CARTRIDGE LATCHING SYSTEM

BACKGROUND OF THE INVENTION

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and typically include a movable print carriage that supports one or more print cartridges each having ink ejecting nozzles. The print carriage traverses back and forth over the surface of the print medium, and the nozzles are controlled to eject drops of ink at appropriate times pursuant to command of a microcomputer or other controller, wherein the timing of the application of the ink drops is intended to correspond to the pattern of pixels of the image being printed. Typically, a plurality of rows of pixels are printed in each traverse or scan of the print carriage. The particular ink ejection mechanism within the printhead may take on a variety of different forms known to those skilled in the art, such as those using thermal printhead or piezoelectric technology. For instance, two earlier thermal ink jet ejection mechanisms are shown in commonly assigned U.S. Pat. Nos. 5,278,584 and 4,683,481. In a thermal system, an ink barrier layer containing ink channels and ink vaporization chambers is disposed between a nozzle orifice plate and a thin film substrate. The thin film substrate typically includes arrays of heater elements such as thin film resistors which are selectively energized to heat ink within the vaporization chambers. Upon heating, an ink droplet is ejected from a nozzle associated with the energized heater element. By selectively energizing heater elements as the printhead moves across the print medium, ink drops are ejected onto the print medium in a pattern to form the desired image.

Certain ink jet printers employ disposable print cartridges that are replaced when empty, and a consideration with such printers is the need to accurately and consistently position a print cartridge in the printer relative to another print cartridge and relative to the entire printer.

BRIEF DESCRIPTION OF THE DRAWINGS

The advantages and features of the disclosed invention will readily be appreciated by persons skilled in the art from the following detailed description when read in conjunction with the drawing wherein:

FIG. 6 is a schematic front partial perspective view of the print carriage of FIG. 4, with the cartridges and the latch assemblies removed.

FIG. 7 is a schematic rear partial perspective view of the print carriage of FIG. 4, with the cartridges and the latch assemblies removed.

FIG. 8 is a schematic sectional elevational view of a chute and latch assembly of the print carriage of FIG. 4.

FIG. 9 is a schematic plan view of a pivoting clamp of the latch assembly of the print carriage of FIG. 4.

DETAILED DESCRIPTION OF THE DISCLOSURE

Figure 1:
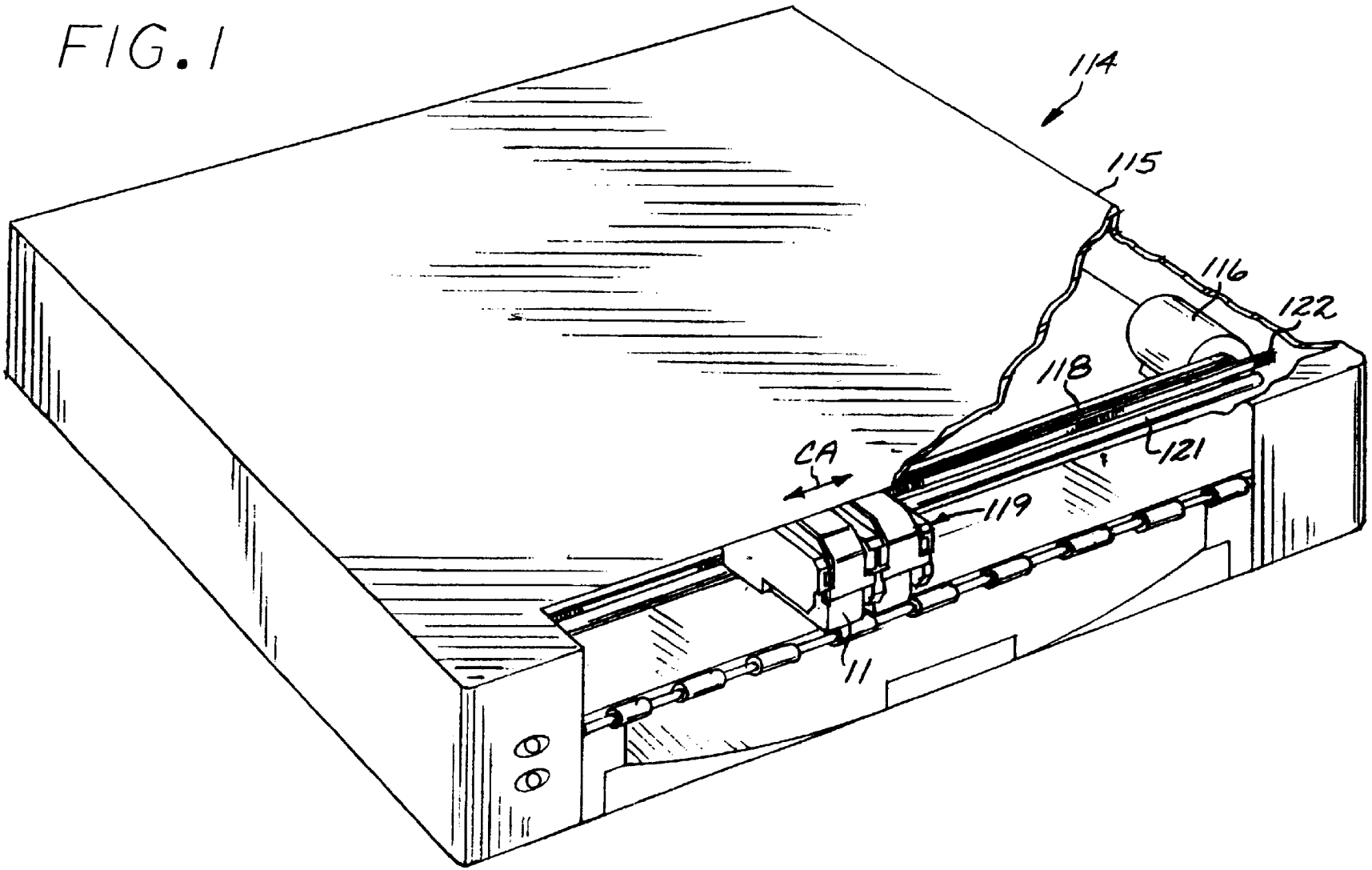
FIG. 1 is a schematic partial cut away perspective view of a printer embodying principles of the invention.

In the following detailed description and in the several figures of the drawing, like elements are identified with like reference numerals.

Referring now to FIG. 1, schematically depicted therein is an ink jet printer 114 partially cut away and with its front loading door removed. The printer includes a case or housing 115 and carriage drive motor 116 mounted on a chassis. The motor drives a belt 118 back and forth as the drive motor reverses direction. The drive belt 118 is attached to a print carriage 119 that scans laterally back and forth along a carriage scan axis CA from left to right and right to left. The print carriage 119 contains two externally similar thermal ink jet print cartridges 11 located side by side. For example, one of the print cartridges can contains black ink while the other has three ink chambers containing magenta, yellow and cyan inks. The horizontal scanning motion of the print carriage 119 is guided by a slider rod 121. Located in the rear of the carriage 119 is an encoder, not shown, that reads a position encoder strip 122 provides information of the location of the print carriage 119 along the carriage axis CA.

Figure 4:
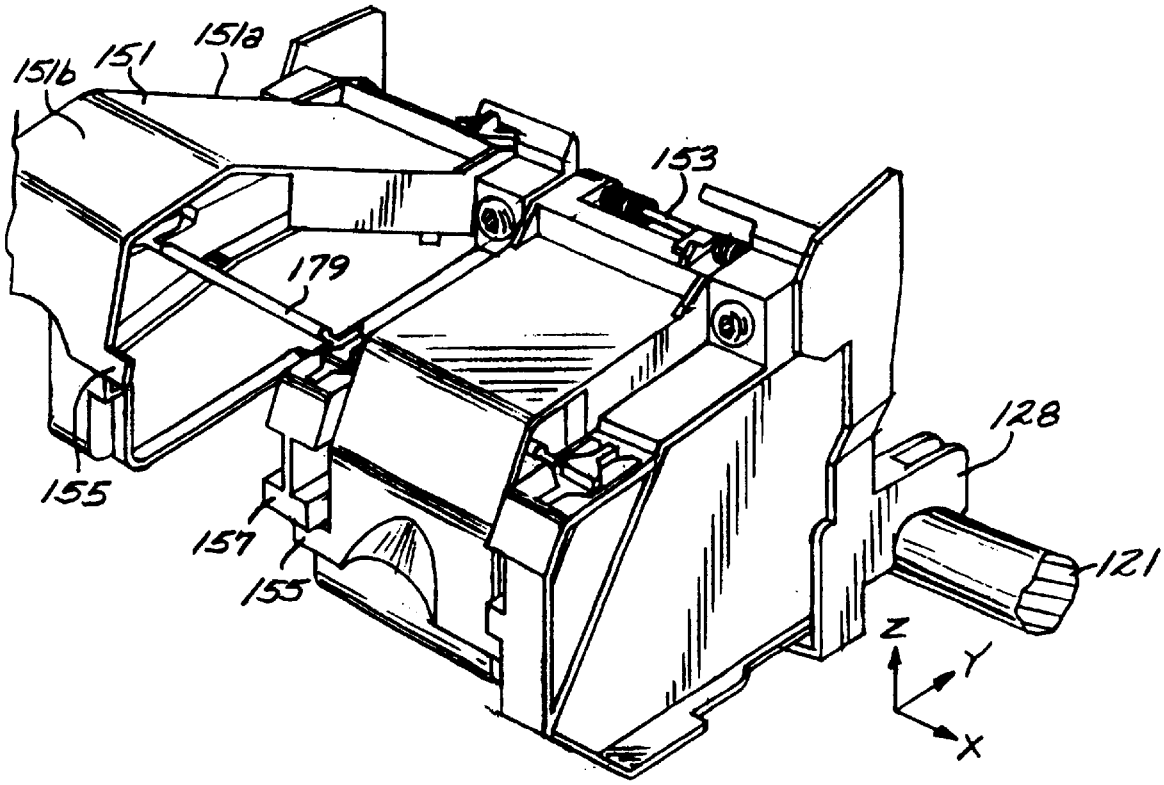
FIG. 4 is a schematic perspective view of the print carriage of the printer of FIG. 1.
Figure 5:
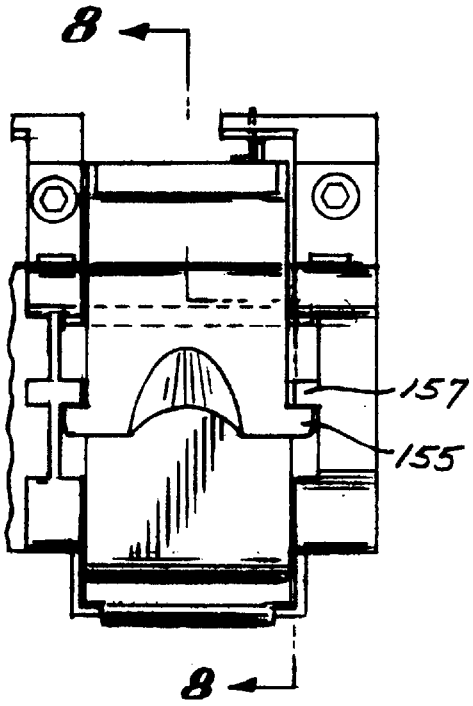
FIG. 5 is a schematic front elevational view of a chute and latch of the print carriage of FIG. 4.
Figure 10:
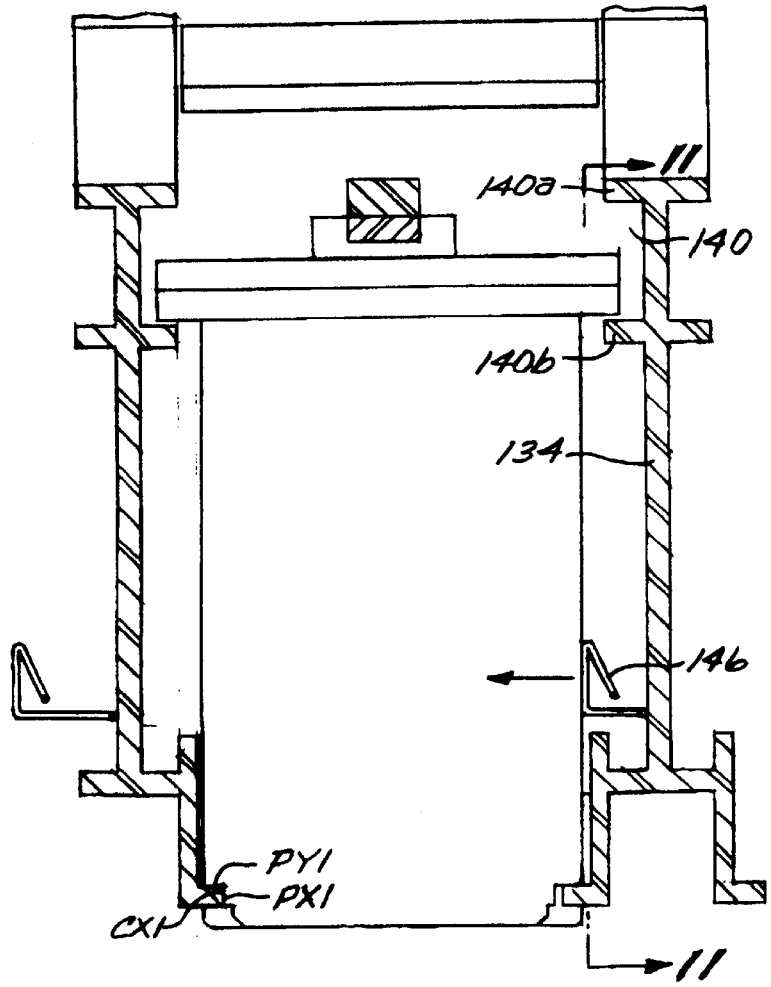
FIG. 10 is a schematic sectional elevational view of a chute of the print carriage of FIG. 4.
Figure 11:
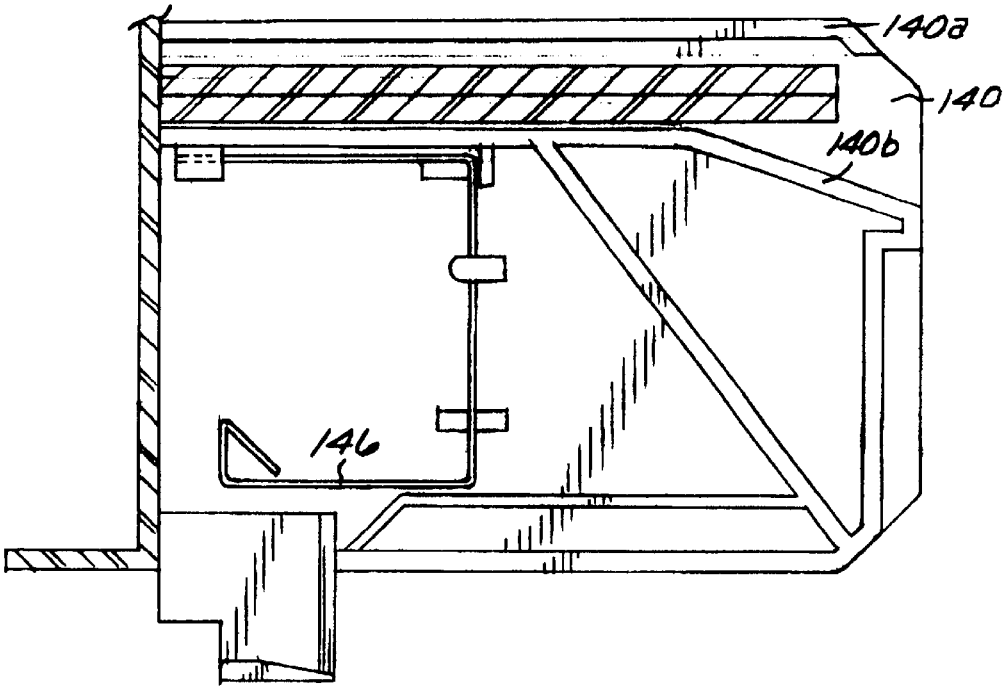
FIG. 11 is a schematic sectional elevational view of a side wall of a chute of the print carriage of FIG. 4.

The print carriage 119 includes a cartridge latching system that consistently and accurately positions the print cartridges 11 relative to an orthogonal coordinate system shown in FIG. 4. The X axis is parallel to the carriage scan axis. The Y axis is parallel to and opposite a paper advance path which for example extends horizontally out of the printer 114, such that the X and Y axes define a horizontal plane. The Z axis extends vertically to the XY plane.

Figure 2:
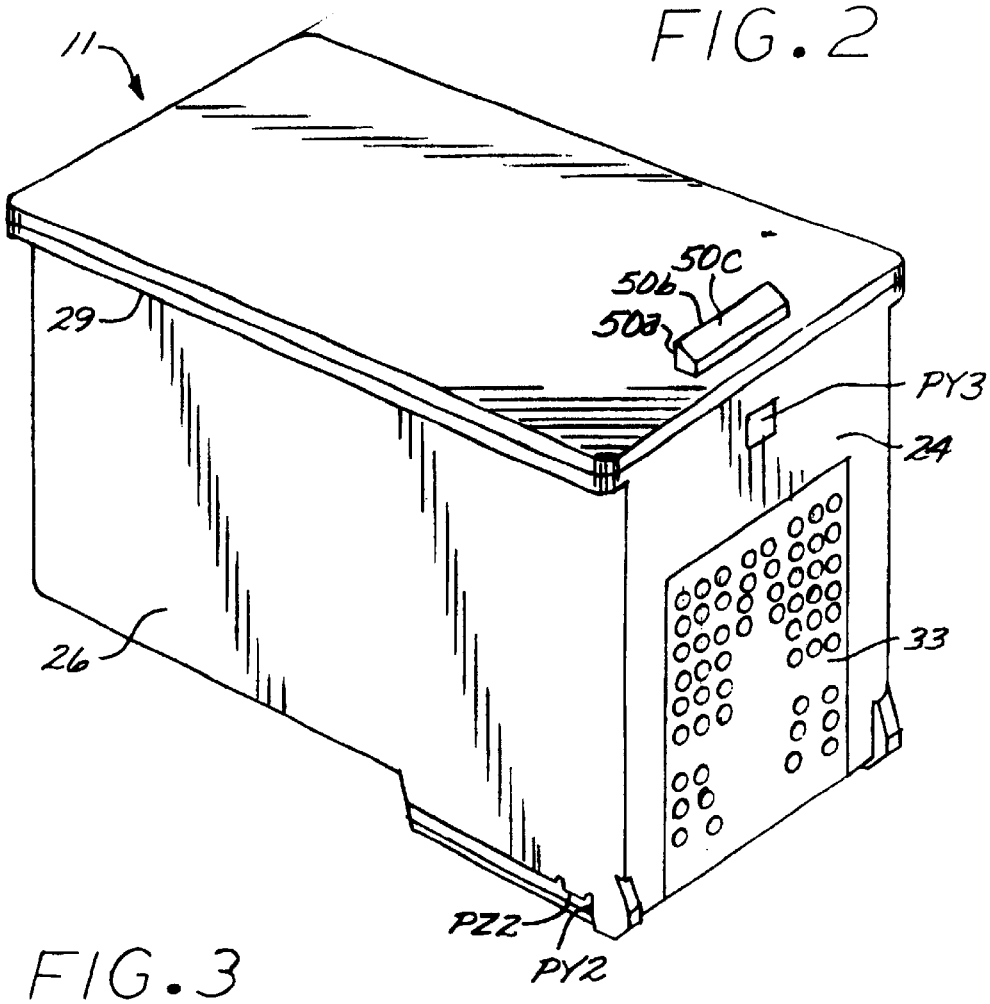
FIG. 2 is a schematic perspective view of an ink jet print cartridge of the printer of FIG. 1.
Figure 3:
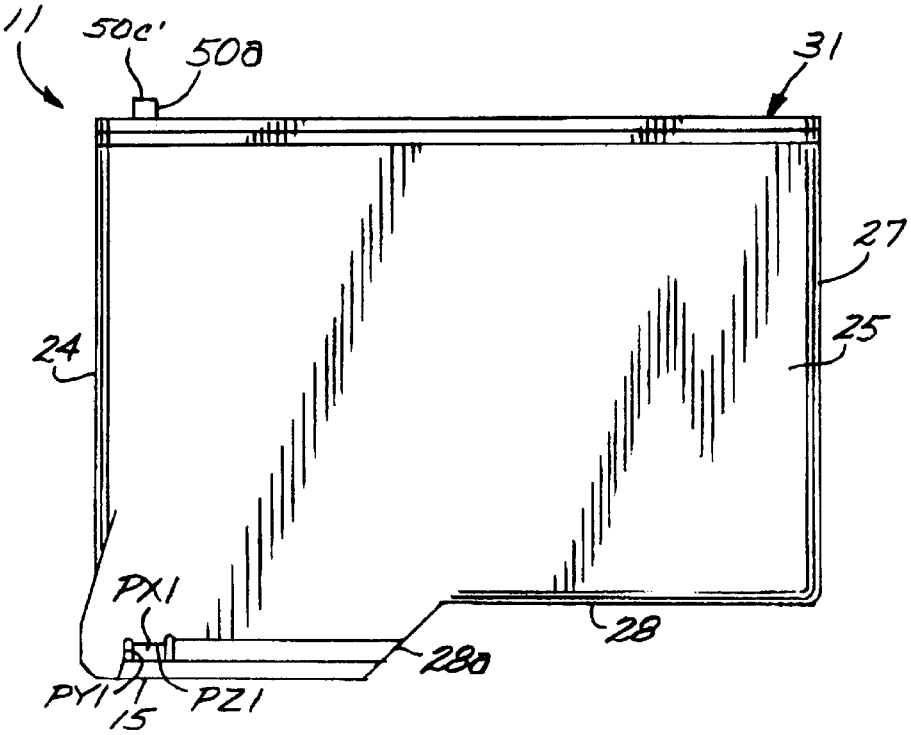
FIG. 3 is a schematic side elevational view of the ink jet print cartridge of FIG. 2.

Referring now to FIGS. 2 and 3, the print cartridge 11 more particularly includes a print cartridge body comprised of a rear wall 24, a left side wall 25, a right side wall 26, a front wall 27, and a bottom wall 28 that includes a snout section 28*a* that supports an ink jet printhead 15. A top wall or lid 31 is attached to the upper edges of the front, side, and rear walls, and includes margins or lips 29 that extend beyond the front and side walls. A latch catch or feature 50 is disposed on the lid 31 close to the top boundary of the rear wall 24. The latch feature 50 extends upwardly from the top wall 31 and includes a front latch surface 50*a* and a rearwardly extending surface 50*c* that intersects the top of the front latch surface 50 at an edge surface 50*b*. By way of illustrative example, the front latch surface 50*a* is perpendicular to the lid 31 while the rearwardly extending surface 50*c* is a ramped surface that extends downwardly and rearwardly from the top of the front latch surface 50*a*. Alternatively, the rearwardly extending surface of the latch feature can comprise a horizontal surface 50*c*' as illustrated in FIG. 3. As described further herein, a latch pushes on a top portion of the latch feature 50. Depending upon implementation that top portion is the edge surface 50*b* or the horizontal surface 50*c*'.

Located in the vicinity of the intersection of the left side wall 25, rear wall 24 and snout 28*a* are a printhead cartridge X axis datum PX1, a first printhead cartridge Y axis datum PY1, and a first printhead cartridge Z axis datum PZ1.

Located in the vicinity of the intersection of the right side wall 26, rear wall 24 and snout 28*a* are a second printhead cartridge Y axis datum PY2 and a second printhead cartridge Z axis datum PZ2. A third printhead cartridge Y axis datum PY3 is located in the upper portion of the rear wall 24. The print cartridge Y axis datums generally comprise lands that are configured to be generally orthogonal to the Y axis when the cartridge is installed in the print carriage 40. The print cartridge Z axis datums comprise lands that are configured to be generally orthogonal to the Z axis when the print cartridge is installed in the print carriage 119. The print cartridge X axis datum comprises a land that is configured to be generally orthogonal to the X axis when the print cartridge is installed in the print carriage 119.

Located on the rear wall 24 is a flex circuit 33 of conventional construction. The flex circuit 33 provides electrical interconnection between the printer and the print head 15, and routes electrical signals to the appropriate heater resistors of the printhead during printing.

Referring now to FIGS. 4–11, the print carriage 119 more particularly includes a base 126 that supports the structure, and two C-shaped bearings 128 located at the ends of the base 126. These C-shaped bearings 128 slidably support the print carriage 119 on the slider rod 121. The print carriage 119 further includes two chutes 131 that each receive, hold, and align an ink jet print cartridge 11. Both chutes are constructed and operate similarly. Each chute includes a rear wall 135 that comprises for example a portion of the base 126, a left side wall 133 that extends from the rear wall 135, and a right side wall 134 that extends from the rear wall 135 and is generally parallel to the left side wall 133.

Carriage datums CY1, CZ1 and CX1 formed for example as part of the base 126 are located at the bottom of the chute 131 in the vicinity of the intersection of the left side wall 133 the rear wall 135, while carriage datums CY2 and CZ2 for example as part of the base 126 are located at the bottom of the chute 131 in the vicinity of the vicinity of the intersection of the right side wall 134 and the rear wall 135. A carriage datum CY3 is located on the rear wall 135.

A resilient contact circuit 137 is located on the rear wall 135 of the chute and contains electrical contacts that are urged against corresponding contacts on the flex circuit 33 of the print cartridge 11. The resilient contact circuit 137 further functions as a resilient element that urges the print cartridge datums PY1, PY2 against carriage datums CY1, CY2 when the print cartridge 11 is installed. By way of illustrative example, the resilient contact circuit 137 comprises a flexible circuit and resilient pad located between the flexible circuit and the rear wall 135.

A cantilever spring 146 is located adjacent the right side wall 134, and functions to urge the print cartridge away from the right side wall 134 along the X-axis, so that the print cartridge datum PX1 is snugly engaged against the carriage datum CX1.

Located in each side wall 133, 134 is a shaped guide channel 140. The guide channels 140 engage lips 31 of the print cartridge 11, and guide the cartridge at an appropriate elevation and pitch (or rotation) of the cartridge about the X axis as the cartridge is inserted, so as to guide the cartridge into the general vicinity of the carriage datums. By way of illustrative example, each guide channel comprises a upper and lower rails 140*a*, 140*b* or a recessed slot having appropriate sides.

A cross bar spans 179 the upper part of the front portion of chute 131 and is located above the guide channels 140. The cross bar prevents insertion of the cartridge from above, and further prevents spreading of the side walls in the event the cartridge is forced too low in the chute.

Located at the top of each chute 131 is a hinged latch assembly 150 that includes a latch support arm 151 that is pivotally attached by a hinge 153 to the top of the rear wall 135 so as to be hingably rotatable about a hinge axis that is parallel to the X-axis. The latch support arm 151 is generally L-shaped having a first leg 151*a* that extends from the hinge 153 and a second leg 151*b* that extends generally downwardly from the distal end of the first leg 151*a*. Latch hooks 155 are located at the ends of the second leg 151*b* for engaging latch tabs 157 disposed at the front of the side walls 133, 134.

A pivoting biased clamp lever 159 is pivotally attached to the lower side of the latch arm 151 by a pivoting clamp hinge 161 that is displaced from the latch arm hinge 153 and parallel thereto so as to be pivotable about a pivoting clamp hinge axis that is parallel to the X axis. The clamp lever 159 extends generally toward the chute rear wall 137 when the latch is closed, and forms an acute angle with an imaginary line that extends between the latch arm hinge axis and the pivoting clamp hinge axis. The clamp lever 159 is biased by a spring 163 to pivot away from the latch arm 151. Stops 165 on either side of the clamp lever 159 limit the rotation of the track lever away from the latch arm 151.

land 167 is disposed at the distal portion of the pivoting clamp 159 for pushing down on the top portion (50*b*, 50*c*') of the latch feature 50 of the print cartridge 11. Extending beyond the land 167 is an extension 169 that prevents the clamp 159 from jamming on the front latch surface 50*a* of the latch feature 50.

The pivoting clamp lever 159 further includes tracks 171 in which a sliding clamp arm 173 is slidably located for movement generally orthogonally to the pivoting clamp hinge axis. The sliding clamp arm 173 is biased by a spring 175 to slide along the pivoting clamp lever 159 away from the pivoting latch hinge 161. Stops 175 limit the displacement of the sliding clamp 173. A sliding clamp land 177 is disposed at the distal end of the sliding clamp 173 adjacent the pivoting clamp land 167.

In use, the cartridge 11 is inserted generally horizontally into the chute 131. The guide channels 140 control the elevation and the pitch about the X axis of the cartridge 11 as it is inserted into the chute 131, such that print cartridge datums PY1, PY2 move over the corresponding carriage datums CY1, CY2. The latch arm 151 is then pivoted downwardly which causes the sliding clamp land 177 and the pivoting clamp land 167 to eventually engage the front latch surface 50*a* and top portion (50*b*, 50*c*') of the latch feature 50 on the top of the cartridge. Continued displacement of the latch arm 151 causes the sliding clamp 173 to resiliently push on the latch feature generally along the Y axis, and further causes the pivoting clamp 159 to push on the latch feature generally along the Z axis. The push generally along the Y axis is independent of the push generally along the Z axis. The push along the Z axis causes the print cartridge datums PZ1, PZ2 to snugly seat against the carriage datums CZ1, CZ2. The push along the Y axis causes the print cartridge to pivot about the X axis so that the print cartridge datum PY3 snugly seats against the carriage datum CY3. The resilient contact circuit 137 is located so as to cause the print cartridge datums PY1, PY2 to seat snugly against the carriage datum CY1, CY2 when the print cartridge datums PZ1, PZ2 are engaged with the carriage datums CZ1, CZ2, and the print cartridge datum PY3 is engaged with the carriage datum CY3.

The latch arm 151 is further displaced to engage the latch hooks 155 with the latch tabs 157, which allows the sliding clamp land 177 and the pivoting clamp land 167 to continually press against the front surface 50*a* and the top portion (50*b*, 50*c*') of the latch feature 50 along the Y and Z axes so that the print cartridge datums PY1, PY2, PY3, PZ1, PZ2 are continually engaged with the corresponding carriage datums CY1, CY2, CY3, CZ1, CZ2. The wire spring 146 pushes the cartridge generally along the X axis so that the print cartridge datum PX1 is snugly engaged with the carriage datum CX1.

In this manner, the print cartridge datums are snugly seated against corresponding carriage datums, which fixes the position of the print cartridge in the chute 131. The forces in the X, Y, and Z axes that seat the print cartridge are substantially independent, and can be optimized independently.

Although the foregoing has been a description and illustration of specific embodiments of the invention, various modifications and changes thereto can be made by persons skilled in the art without departing from the scope and spirit of the invention as defined by the following claims.

What is claimed is:

1. A print carriage comprising:

a chute for receiving a print cartridge and having carriage Y-axis datums and Z-axis datums;

a latch arm hingeably attached to said chute;

a pivoting clamp supported by said latch arm and slidable relative thereto for pushing the print cartridge generally along a Y-axis that is orthogonal to the Z-axis so that the print cartridge contacts said Y-axis datums.

2. The print carriage of claim 1 wherein said latch arm is pivotable about a latch arm hinge axis and wherein said pivoting clamp is pivotable about a pivoting clamp axis that is parallel to said latch arm hinge axis.

3. The print carriage of claim 2 wherein said pivoting clamp comprises:

a clamp lever that extends from said pivoting clamp pivot axis and forms an acute angle with a line segment that extends orthogonally between said latch arm hinge axis and said pivoting clamp pivot axis;

a pivoting clamp land on said lever displaced from said pivoting clamp pivot axis; and a spring for urging said lever to rotate about said pivoting clamp pivot axis.

4. The print carriage of claim 3 wherein said clamp includes an extension that extends from said pivoting clamp land.

5. The print carriage of claim 3 wherein said lever includes tracks for guiding said sliding clamp.

6. The print carriage of claim 5 wherein said sliding clamp comprises a sliding arm having a sliding clamp land at one end thereof adjacent said pivoting clamp land.

7. A print carriage comprising:

a chute for receiving a print cartridge having a latch feature that includes a top surface and a front surface adjacent the top surface;

carriage Y-axis datums and Z-axis datums located in said chute;

a latch arm hingeably attached to said chute for rotation about a latch arm hinge axis;

a pivoting clamp hingeably supported by said latch arm for rotation about a pivoting clamp pivot axis, said pivoting clamp pushing on the top surface of the latch feature of the print cartridge generally along a Z-axis so that the print cartridge contacts said carriage Z-axis datums; and a sliding clamp slidably supported by said pivoting clamp for translation orthogonally to said pivoting clamp hinge and slidable relative to said pivoting clamp, said sliding clamp pushing the front surface of the latch feature of the print cartridge generally along a Y-axis that is orthogonal to the Z-axis so that the print cartridge contacts said Y-axis datums.

8. The print carriage of claim 7 wherein said latch arm hinge axis and said pivoting clamp pivot axis are parallel.

9. The print carriage of claim 8 wherein said latch arm hinge axis and said pivoting clamp pivot axis are parallel to an X-axis that is parallel to a carriage scan axis.

10. The print carriage of claim 7 wherein said pivoting clamp comprises:

a clamp lever that extends from said pivoting clamp pivot axis and forms an acute angle with a line segment that extends orthogonally between said latch arm hinge axis and said pivoting clamp pivot axis;

a pivoting clamp land on said lever displaced from said pivoting clamp pivot axis; and a spring for urging said lever to rotate about said pivoting clamp pivot axis.

11. The print carriage of claim 10 wherein said clamp lever includes an extension that extends from said pivoting clamp land.

12. The print carriage of claim 10 wherein said lever includes tracks for guiding said sliding clamp.

13. The print carriage of claim 12 wherein said sliding clamp comprises a sliding arm having a sliding clamp land at one end thereof adjacent said pivoting clamp land.

14. A print carriage comprising:

a chute for receiving a print cartridge and having carriage Y-axis datums and Z-axis datums;

a resilient pad disposed at a rear portion of said chute engageable by a rear portion of the print cartridge;

a latch arm hingeably attached to said chute;

a pivoting clamp supported by said latch arm for pushing the print cartridge generally along a Z-axis so that the print cartridge contacts said carriage Z-axis datums; and a sliding clamp supported by said latch arm and slidable relative thereto for pushing the print cartridge against said resilient pad and generally along a Y-axis that is orthogonal to the Z-axis so that the print cartridge rotates about an X-axis that is orthogonal to said Z-axis and said Y-axis, and contacts said Y-axis datums.

15. The print carriage of claim 14 wherein said latch arm is pivotable about a latch arm hinge axis and wherein said pivoting clamp is pivotable about a pivoting clamp axis that is parallel to said latch arm hinge axis.

16. The print carriage of claim 15 wherein said pivoting clamp comprises:

a clamp lever that extends from said pivoting clamp pivot axis and forms an acute angle with a line segment that extends orthogonally between said latch arm hinge axis and said pivoting clamp pivot axis;

a pivoting clamp land on said lever displaced from said pivoting clamp pivot axis; and a spring for urging said lever to rotate about said pivoting clamp pivot axis.

17. The print carriage of claim 16 wherein said clamp lever includes an extension that extends from said pivoting clamp land.

18. The print carriage of claim 16 wherein said lever includes tracks for guiding said sliding clamp.

19. The print carriage of claim 18 wherein said sliding clamp comprises a sliding arm having a sliding clamp land at one end thereof adjacent said pivoting clamp land.

20. A print carriage comprising:

a chute for receiving a print cartridge and having carriage Y-axis datums and Z-axis datums;

a latch arm hingeably attached to said chute;

clamping means for applying a first force to the print cartridge generally along a Z-axis so that the print cartridge contacts said carriage Z-axis datums, and for applying a second force to the print cartridge generally along a Y-axis that is orthogonal to the Z-axis so that the print cartridge contacts said Y-axis datums; and wherein the first force and the second force are applied substantially independently of each other.

21. A method of latching a print cartridge having a latching feature in a print carriage, comprising:

moving a print cartridge into a print carriage;

applying a first clamping force to a first surface of the latching feature along a first direction;

applying a second clamping force to a second surface of the latching feature along a second direction that is generally orthogonal to the first direction;

and wherein applying a first clamping force comprises pushing a pivoting clamp against the first surface, and wherein applying a second clamping force comprises pushing a sliding clamp against the second surface.

* * * * *